United States Patent [19]

Lewis

[11] 4,030,237

[45] June 21, 1977

[54] SPINNING BALLOON NOVELTY

[76] Inventor: Nathanial H. Lewis, Box No. 20424, Los Angeles, Calif. 90006

[22] Filed: July 15, 1975

[21] Appl. No.: 596,011

[52] U.S. Cl. ..... 46/53; 46/89

[51] Int. Cl.[2] ..... A63H 3/06

[58] Field of Search ..... 46/53, 57, 87, 88, 89

[56] References Cited

UNITED STATES PATENTS

| | | | |
|---|---|---|---|
| 2,748,532 | 6/1956 | Gergovich et al. | 46/87 |
| 2,783,584 | 3/1957 | Venturella | 46/89 |
| 3,457,669 | 7/1969 | Green | 46/53 |
| 3,806,073 | 4/1974 | Christie | 46/53 |

*Primary Examiner*—Louis G. Mancene
*Assistant Examiner*—Robert F. Cutting

[57] ABSTRACT

An inflatable balloon mounted on a hub having pinwheel vanes attached thereto. The device is suspended by a string and may be attached to a moving vehicle or held by hand for free rotation of the pinwheel and the balloon.

3 Claims, 8 Drawing Figures

SPINNING BALLOON NOVELTY

An inflatable balloon mounted on a hub having pinwheel vanes attached thereto, The device is suspended by a string and may be attached to a moving vehicle or held by hand for free rotation of the pinwheel and the balloon.

A spinning balloon novelty will come in several versions of two types; its "brand name" will be COMET, just a suggestion. Basically, this invention will comprise a balloon with a mounted "pinwheel-type" vanes' assembly. The said balloon is free to rotate on a suspension assembly; whenever, air currents strikes its vanes.

The "cycle-type" is designed to be suspended from a handlebar of a bicycle or a tricycle, by its arm assembly. These vehicles have increased greatly in recent years. The said type is designed to amuse children, while they ride their bicycles and tricycles. The said "cycle-type" can be mounted onto either or both sides of a cycle for amusement purpose. An excellent occasion would be a parade.

The "display-type" is ideal for parties and displays; particularly, the large glamorous ones. The said "display-type" would come in a wide variety of designs and colors.

The said two types can have air whistles (or some other sound producing instrument) attached to the said spinning balloon novelty, for additional amusement. An adequate patent search and market analysis has indicated that; the said invention has novelty and amusement value.

The said invention will become better understood hereinafter from a consideration of the specification with reference to the accompanying drawings forming part thereof, and in which like numerals correspond to like parts through the several views of the said invention, and wherein.

Figure 1:
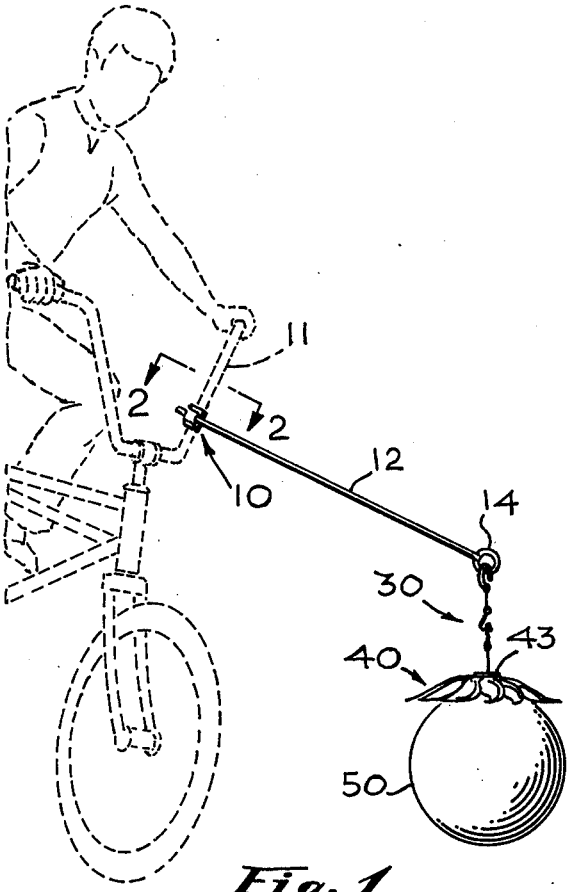
FIG. 1 is a perspective view of the spinning balloon novelty suspended from its arm assembly. The said arm assembly in turn is mounted onto a handlebar, of a bicycle-boy combination shown in dashed lines.

Referring to FIG. 1; an arm assembly will comprise a mounting-unit 10 and a hollow shaft 12 with an "O" ring 14. The said arm assembly should angle "downward" and "sideward" for the best spinning effect of the said invention. The said arm assembly is suspended from a handlebar 11.

The overall length of the suspension assembly 30, from the bottom of the "O" ring 14 down to the thin disk 43, should not be over four inches long. Thereby, the said spinning balloon novelty will not have excessive movements, to the sides, forward or backward; which would be undesirable. A circular or pear-shaped balloon 50 performs the best. The said vanes' assembly 40 must be level (or nearly so) top side of balloon 50, for effective result. The balloon 50 should be a heavy duty one.

Figure 2:
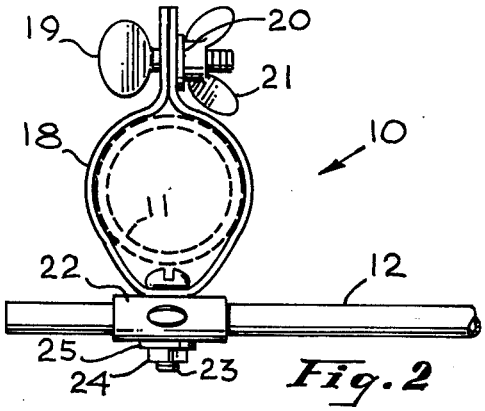
FIG. 2 is an enlarged top plan view of the mounting-unit, shown in combination with the phantom handlebar and part of the shaft; take on line 2—2 of FIG. 1.
Figure 3:
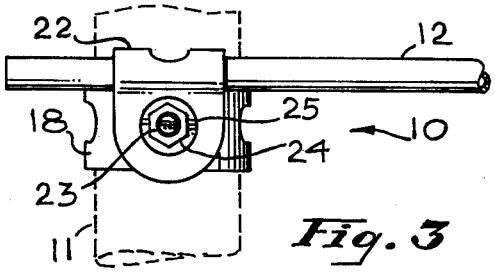
FIG. 3 is a side plan view of FIG. 2.

Refer to FIG. 2. The mounting-unit 10 comprise a long section 18 secured around the handlebar 11, with a thumb screw 19, a washer 20, and a wing nut 21. Secured to the long section 18 is a short section 22; it is fasten around the shaft 12 with a bolt 23, a nut 24, and a washer 25 combination. Refer to FIG. 3 for another view of the mounting-unit 10 mounted onto the handlebar 11.

Figure 4:
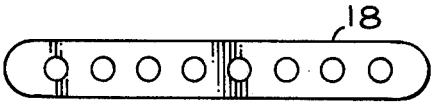
FIG. 4 is a reduced top plan view of the long section, of the said mounting-unit.
Figure 5:
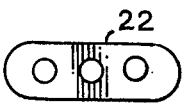
FIG. 5 is a reduced top plan view of the short section, of the said mounting-unit.

Referring to FIGS. 4 and 5, the long section 18 and the short section 22 are shown respectively, in their flattened out state. These sections 18 and 22 can be made from strips of plumbing tape; however, the holes should be equally spaced, of equal size, centered, and in alignment with one another.

Figure 6:
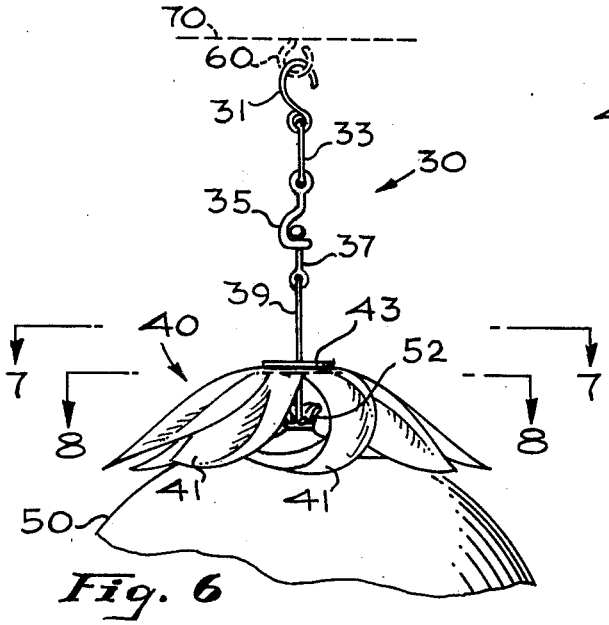
FIG. 6 is an enlarged fragmentary view of the balloon, "pinwheel-type" vanes' assembly, and suspension assembly combination; the said combination shown hanging from phantom support.

Refer to FIG. 6, for a close-up view of the said spinning balloon novelty. A hook 31, a cord like uppersegment 33, upper portion 35 of the pivot joint, lower portion 37 of the pivot joint, and a cord like lower-segment 39 comprise the suspension assembly 30. However, the upper segment 33 can be eliminated, and the hook 31 and the upper portion 35 made one unit.

The "pinwheel-type" vanes' assembly 40 comprise a series of vanes 41, and a thin disk 43 with a small hole in its center. The assembly 40 is mounted upon a blown-up balloon 50; note fasten stem 52 of the balloon 50.

In FIG. 6, the illustration of the said spinning balloon novelty, is that of the "display-type." The said spinning balloon novelty is hanging from a hook 60 - structure 70 combination.

Figure 7:
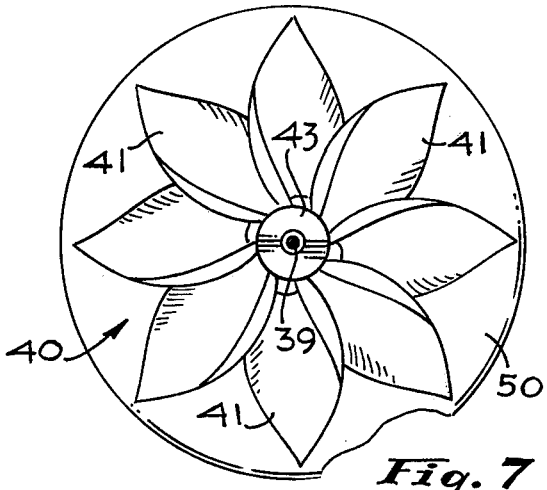
FIG. 7 is a top view of FIG. 6 taken on line 7-7.

Refer to FIG. 7 for a better understanding of the said spinning balloon novelty construction and operation. The lower-segment 39 which is a piece of tie string or cord (or the like), is inserted through the small hole in the center of the disk 43, of the vanes' assembly 40. The lower-segment 39 should fit fairly tight inside the said hole; thereby, helping to stabilize the vanes' assembly 40 onto the balloon 50.

Figure 8:
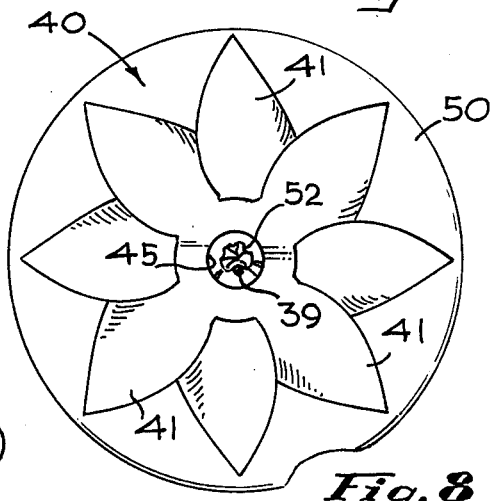
FIG. 8 is a top view of FIG. 6 taken on line 8-8.

Referring now to FIG. 8. A large hole 45 into which the stem 52 of the balloon 50 is inserted into; after the balloon 50 is blown-up, and tied with the lower-segment 39. The hole 45 should be reinforced around its circumference, and should be large enough; so that, the vanes' assembly 40 can be leveled and stabilized, onto the balloon 50.

It was the intent of this inventor to invent a simple, but interesting, safe, and workable invention. Therefore, much time and effort went into the engineering, designing, and testing of this invention. Thereby, the tooling, manufacturing, and packaging needed to place it on the marketplace, will be on a level that it is as economical as is possible, relatively speaking. And the selection of the material for each part of this invention, will be a compromise between economic and durability desired. Therefore, material(s) selection will be left up to the manufacturer.

The following is claimed:

1. A combination of a pinwheel rotatably attached with a spherical balloon having a stem and a cord of a suspension assembly; a hub member secured with said pinwheel having an aperture centrally located in said hub member, the balloon being inflated and secured to said cord at its stem, said stem of said balloon attached to said cord and said cord being inserted in said aperture of said hub member, the said suspension assembly includes a swivel attached to said cord to provide rotatability, permitting said pinwheel and said balloon to rotate in a circular path along its longitudinal axis.

2. As claimed in claim 1, a plurality of sounding devices fasten externally to said balloon, and activated by air currents.

3. As claimed in claim 2, a plurality of sounding devices fasten to said pinwheel, and activated by air currents, thereby providing additional amusement.

* * * * *